US006802720B2

(12) United States Patent
Weiss et al.

(10) Patent No.: US 6,802,720 B2
(45) Date of Patent: Oct. 12, 2004

(54) PIN-ARRAY, SEPARABLE, COMPLIANT ELECTRICAL CONTACT MEMBER

(75) Inventors: Roger E. Weiss, Foxboro, MA (US); Christopher Cornell, South Dartmouth, MA (US); David M. Barnum, Dartmouth, MA (US)

(73) Assignee: Paricon Technologies Corporation, Fall River, MA (US)

( * ) Notice: Subject to any disclaimer, the term of this patent is extended or adjusted under 35 U.S.C. 154(b) by 0 days.

(21) Appl. No.: 10/612,527

(22) Filed: Jul. 2, 2003

(65) Prior Publication Data

US 2004/0127071 A1 Jul. 1, 2004

Related U.S. Application Data

(63) Continuation-in-part of application No. 09/465,056, filed on Dec. 16, 1999.

(51) Int. Cl.[7] ..... H01R 12/00

(52) U.S. Cl. ..... 439/66; 439/66; 439/700; 439/74; 439/86; 439/91; 439/591

(58) Field of Search ..... 439/66, 74, 86, 439/91, 591, 700

(56) References Cited

U.S. PATENT DOCUMENTS 5,531,021 A * 7/1996 Kolman et al. ..... 29/843
5,531,022 A * 7/1996 Beaman et al. ..... 29/850
5,810,607 A * 9/1998 Shih et al. ..... 439/66
6,102,709 A * 8/2000 Howard et al. ..... 439/66
6,142,789 A * 11/2000 Nolan et al. ..... 439/66
6,386,890 B1 * 5/2002 Bhatt et al. ..... 439/67

* cited by examiner

*Primary Examiner*—Truc T. T. Nguyen
(74) *Attorney, Agent, or Firm*—Brian M. Dingman, Esq.; Mirick, O'Connell, DeMallie & Lougee, LLP

(57) ABSTRACT

A pin-array, separable, compliant electrical contact member for separably, electrically interconnecting a first electrical device having electrical contacts to a second electrical device having electrical contacts. The inventive device includes a probe housing having a thickness, and defining a plurality of openings through the thickness, one or more pin probes, each pin probe located in and protruding from an opening in the probe housing, and each defining an enlargement larger than the opening in which the pin is located, to inhibit lateral pin motion, and also prevent the pins from being removed from their openings vertically in at least one direction, and a layer of Anisotropic Conductive Elastomer (ACE) adjacent to the probe housing and comprising a plurality of conductive chains of particles through the layer thickness and aligned generally perpendicularly to the layer's major surfaces. One end of the pin probes are in contact with the electrical contacts of the first electrical device, and the other ends of the pin probes are in compressive contact with a major surface of the ACE layer. The other major surface of the ACE layer is in contact with the electrical device, such that electrical signals are passed between the two electrical devices through the pin probes and the ACE layer.

31 Claims, 8 Drawing Sheets

PIN-ARRAY, SEPARABLE, COMPLIANT ELECTRICAL CONTACT MEMBER

CROSS REFERENCE TO RELATED APPLICATION

This application is a continuation in part of application Ser. No. 09/465,056, entitled "Elastomeric Interconnection Device and Methods for Making Same" filed on Dec. 16, 1999. Priority is claimed.

FIELD OF THE INVENTION

This invention relates to the field of separable, compliant electrical connectors.

BACKGROUND OF THE INVENTION

Separable, compliant electrical connectors are typically used for test and burn-in of chips and other electrical components. Typically, chip packages have a large number of closely spaced contacts that must be brought into electrical contact with electrical contacts on a printed circuit board or a like substrate. It is desirable that the contact be low resistance and low inductance while at the same time being quick and simple to accomplish.

Connectors commonly used for this task include pogo pin connectors that include an array of vertically-compliant conductive pins that contact the chip on one end and a substrate on the other end. The vertical compliance is accomplished with conductive springs. Although these pogo pin connectors successfully separably interconnect electrical devices with sufficient vertical compliance for the task, they are expensive and exhibit substantial inductance, which limits the signal transfer rate through the pins. This can be a limiting factor for the types of devices tested as well as the time it takes to conduct the test. Also, the pins of pogo pin connectors require a relatively large spacing between pins, which limits the pitch of the contacts.

SUMMARY OF THE INVENTION

It is therefore an object of this invention to provide a pin-array, separable, compliant electrical contact member.

It is further object of this invention to provide such an electrical contact member that is relatively simple and inexpensive.

It is a further object of this invention to provide such an electrical contact member that has a low inductance.

It is a further object of this invention to provide such an electrical contact member that is relatively robust.

It is a further object of this invention to provide such an electrical contact member that has its contact pins spaced at a very fine pitch.

Anisotropic Conductive Elastomer (ACE) as the term is used herein is a composite of conductive metal particles in an elastomeric matrix that is constructed such that it conducts along one axis only. In general, this material is made to conduct through its thickness. ACE is generally produced by mixing magnetic particles with a liquid resin, forming the mix into a continuous sheet, and curing the sheet in the presence of a magnetic field. This results in the particles forming columns through the sheet thickness that are substantially perpendicular to the major surfaces of the ACE sheet. These columns are electrically conductive, creating anisotropic conductivity.

This invention features a pin-array, separable, compliant electrical contact member for separably, electrically interconnecting a first electrical device having electrical contacts to a second electrical device having electrical contacts. The inventive device includes a probe housing having a thickness, and defining a plurality of openings through the thickness, one or more pin probes, each pin probe located in and protruding from an opening in the probe housing, and each defining an enlargement larger than the opening in which the pin is located, to inhibit lateral pin motion, and also prevent the pins from being removed from their openings vertically in at least one direction, and a layer of ACE adjacent to the probe housing and comprising a plurality of conductive chains of particles through the layer thickness and aligned generally perpendicularly to the layer's major surfaces. One end of the pin probes are in contact with the electrical contacts of the first electrical device, and the other ends of the pin probes are in compressive contact with a major surface of the ACE layer. The other major surface of the ACE layer is in contact with the electrical device, such that electrical signals are passed between the two electrical devices through the pin probes and the ACE layer.

The pin enlargements may be on the ends of the pins that are in contact with the ACE layer, which provides the further benefit that the contact area at the ACE major surface is increased. This can be used to match the pin/ACE contact size and shape to that of the underlying board contact. The pin ends that are in contact with the ACE layer are preferably substantially flat. The probe housing may be a single thin or thick layer, or may comprise two or more spaced layers, to accomplish a desired thickness. The electrical contacts on the first electrical device may have a particular end shape (for example, partially spherical), and the ends of the pins in contact with them may have a complementary shape to maximize contact area and minimize contact damage.

The ACE layer may be coupled to the probe housing, for example with an adhesive or with mechanical members. In one embodiment, the ACE layer is held in tension by the probe housing. The ACE layer may define one or more open areas, and the probe housing may in such case define an opening above the ACE layer discontinuity, to allow the contact member to be placed on a substrate with components protruding from its surface. The pin enlargements may be captured within the probe housing.

The probe housing may comprise vertically spaced layers defining a cavity with in which the pin enlargements are captured. The electrical contact member may further comprise a frame to which the ACE layer is coupled. T he ACE layer maybe held in tension by th e frame. The probe housing may fit within the frame.

The electrical contact member may further comprise means for aligning the probe housing to the second electrical device, which may be accomplished with alignment pins. The electrical contact member may then further comprise an alignment frame, wherein the alignment frame is coupled to the second electrical device with alignment pins, and the probe housing is coupled to the alignment frame by alignment pins. The probe housing may be vertically compressible. The probe housing may comprise one or more vertically-compliant members such as springs to provide vertical compliance to the housing. The top surface of the probe housing may be above the tops of the pins when it is not compressed, to protect the pins from damage.

BRIEF DESCRIPTION OF THE DRAWINGS

Other objects, features and advantages will occur to those skilled in the art from the following description of the preferred embodiments, and the accompanying drawings in which.

Figure 2:
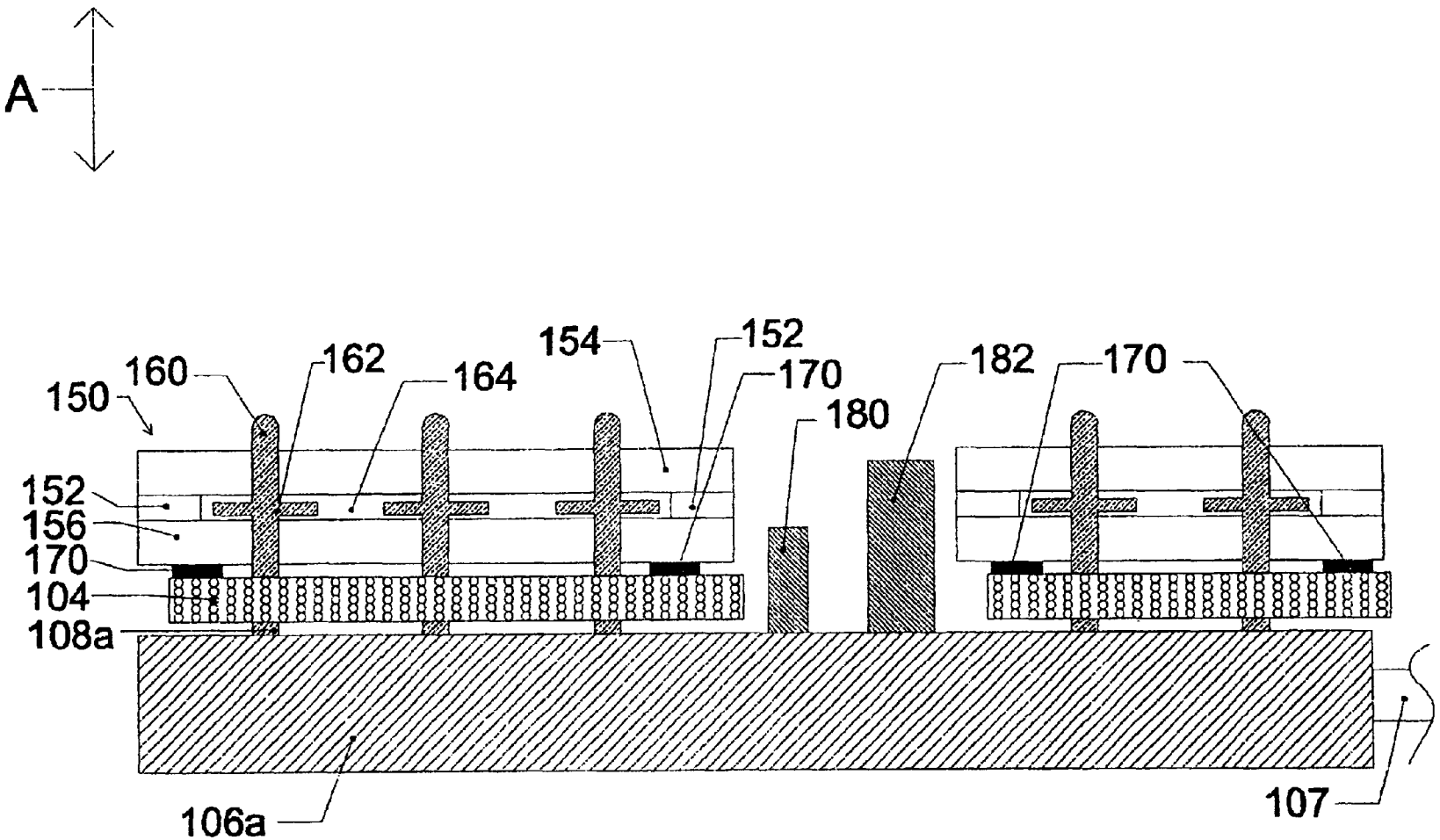
Figure 3:
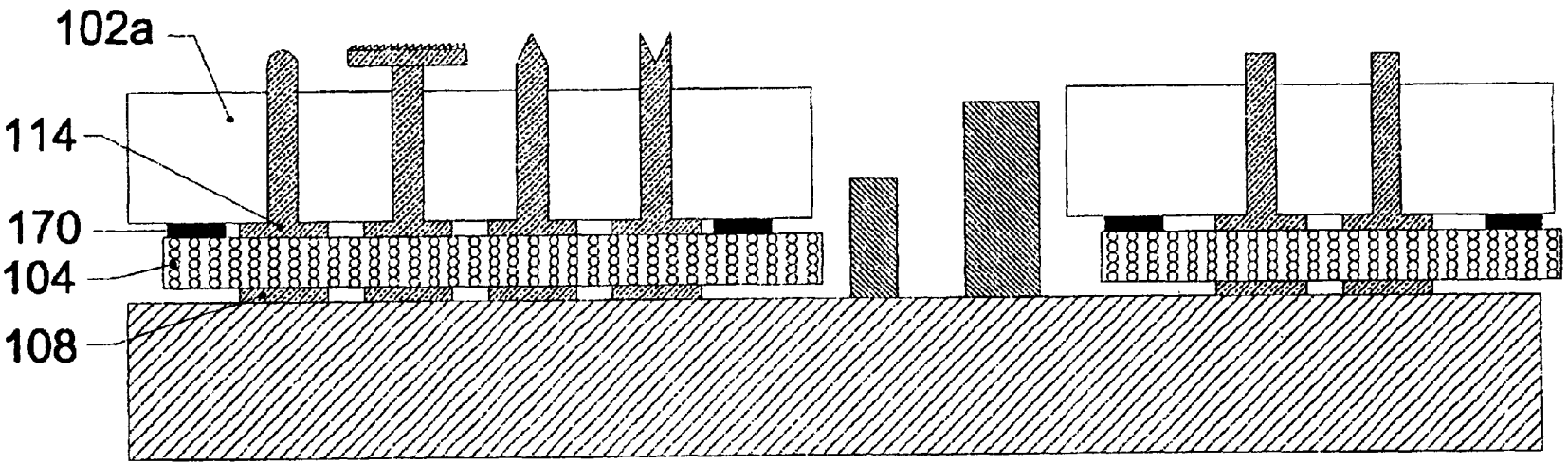
Figure 4:
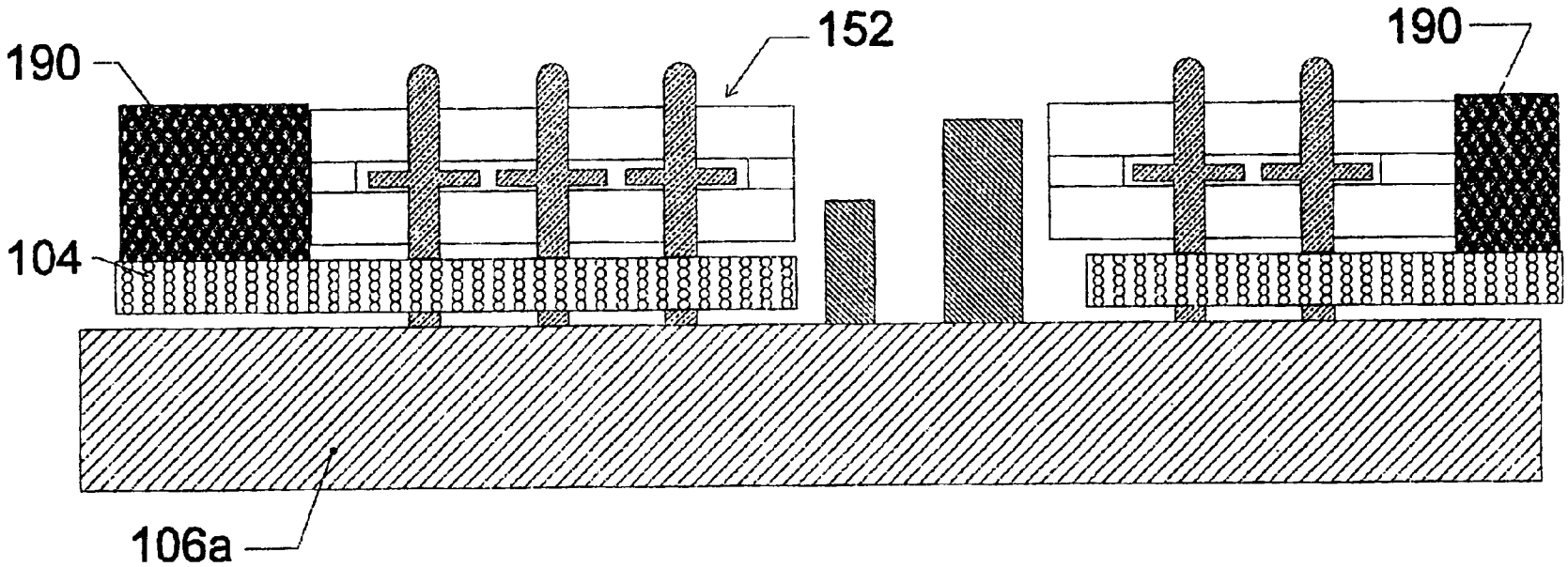
Figure 5:
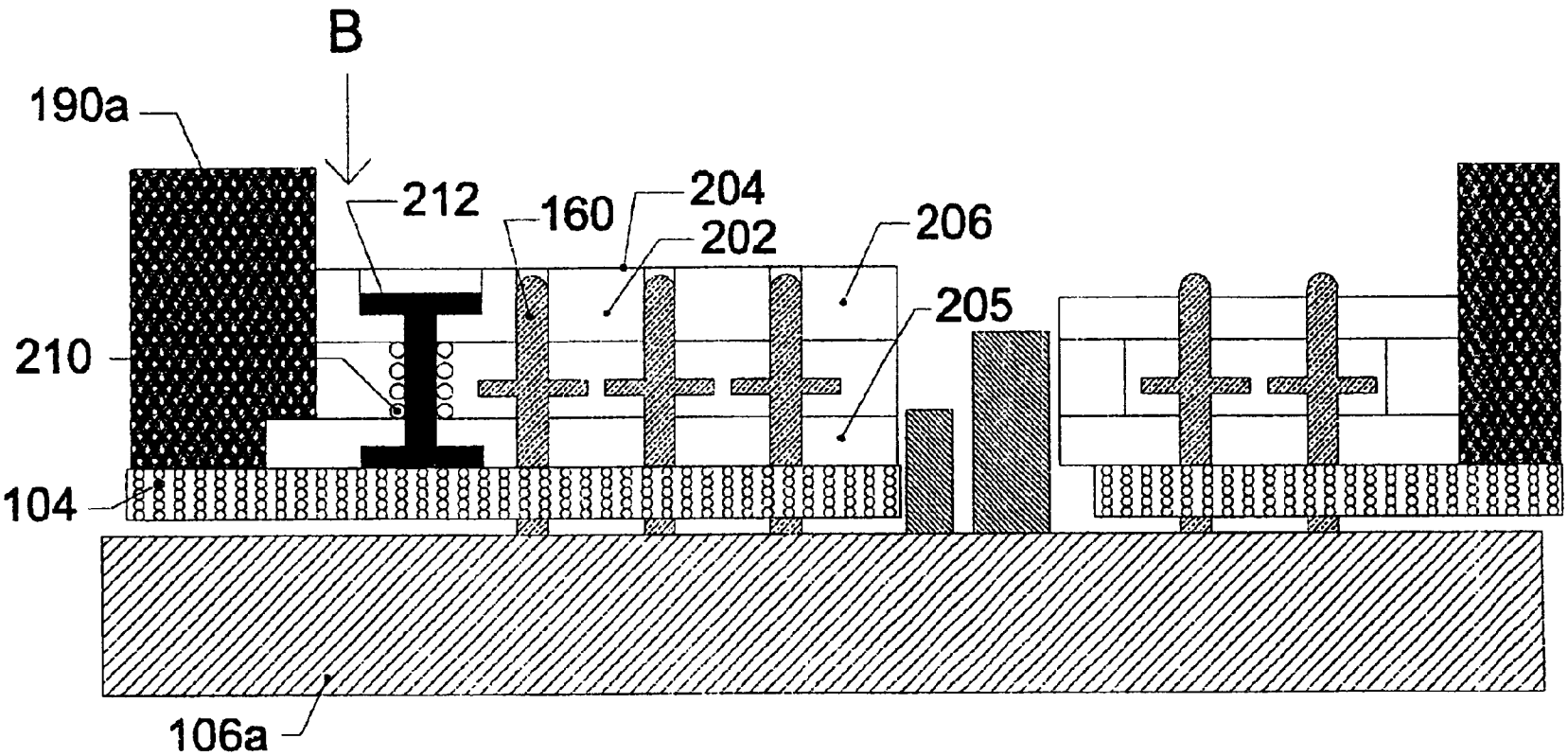
Figure 6A:
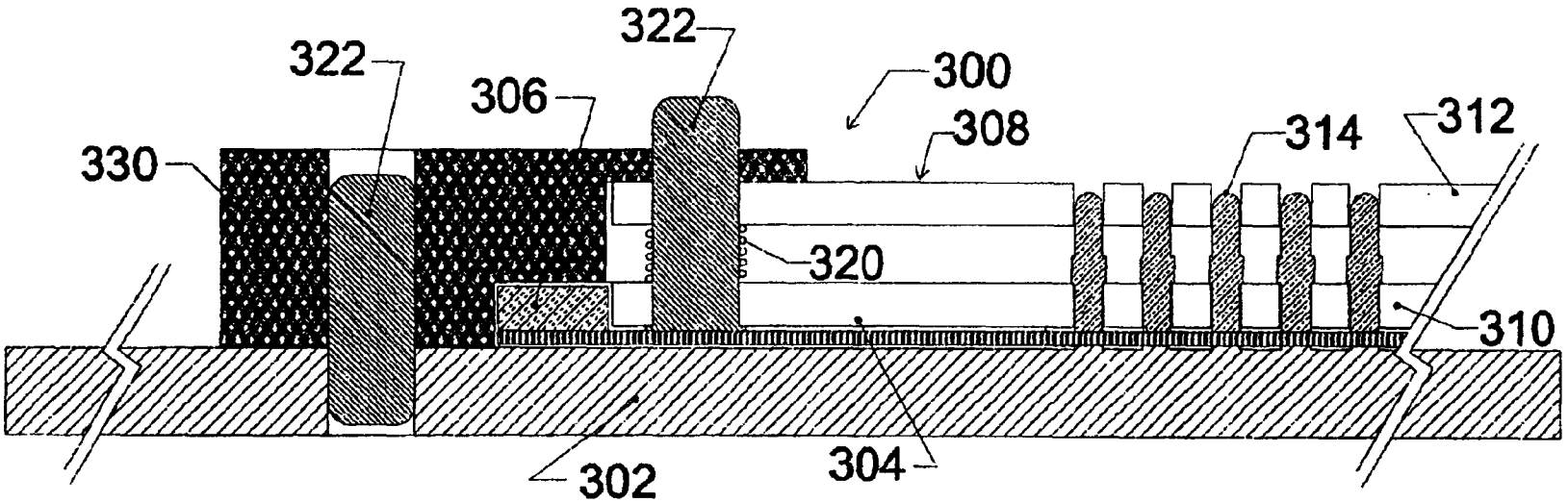
Figure 6B:
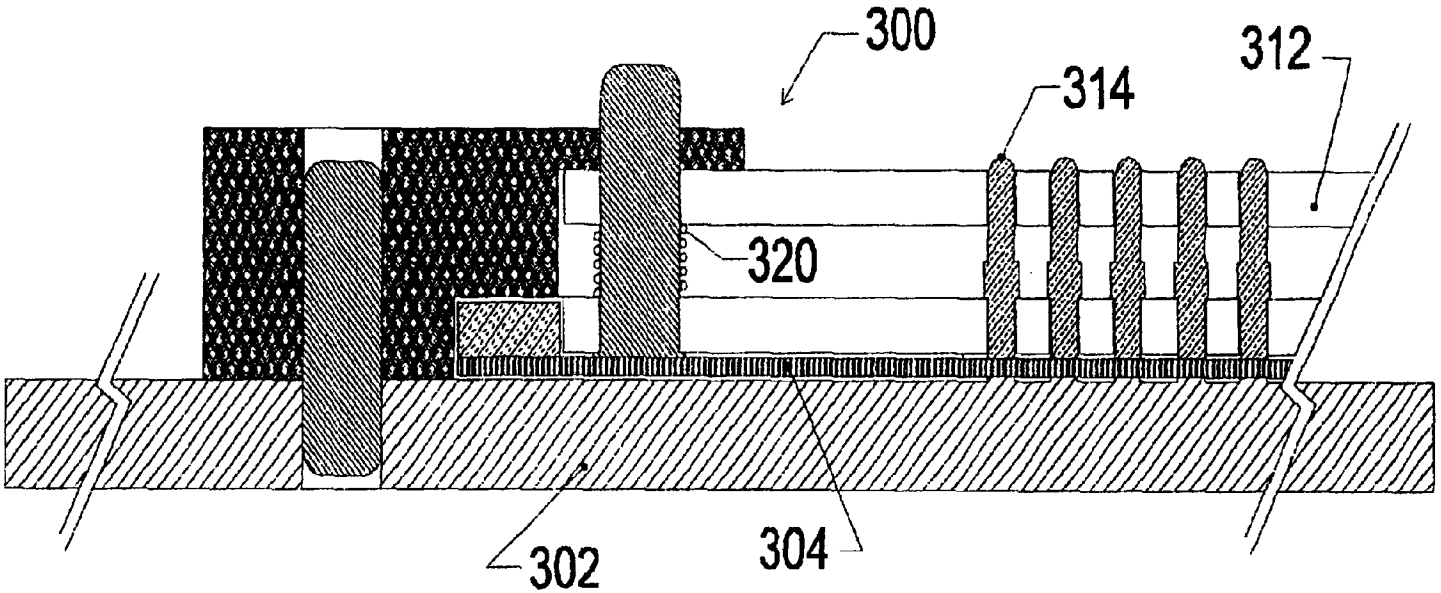
Figure 7:
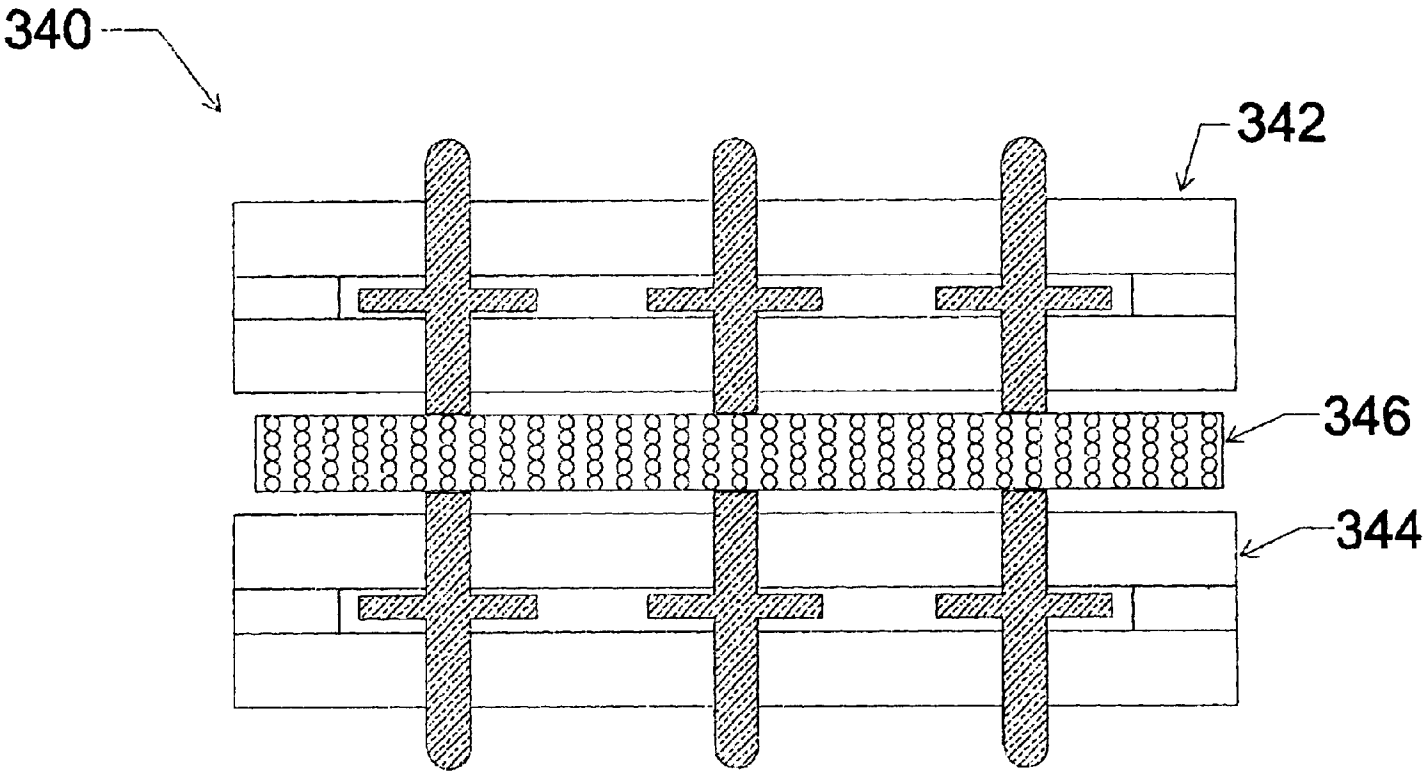

FIB. 1B is a similar view of a slightly different embodiment of the electrical contact member of the invention;

FIG. 2 is a similar view of another preferred embodiment of the electrical contact member of the invention;

FIG. 3 is a similar view of yet another embodiment of the electrical contact member of the invention;

FIG. 4 is a similar view of yet another preferred embodiment of the electrical contact member of the invention;

FIG. 5 is a similar view of an embodiment of the invention in which the probe housing is vertically compressible;

FIGS. 6A and 6B are similar views of yet another preferred embodiment of the invention in which alignment is accomplished with an alignment frame an alignment pins; and FIG. 7 is a similar view of a double-ended electrical contact member of this invention.

DESCRIPTION OF THE PREFERRED EMBODIMENTS

This invention may be accomplished in a pin-array, separable, compliant electrical contact member. The contact member includes relatively short conductive pins held in a probe housing such that the pins can move vertically but not laterally. A layer of Anisotropic Conductive Elastomer (ACE) is held adjacent to the lower end of the pin array. The other surface of the ACE lies against the printed circuit board or other device being connected to. The pins have an enlarged area that prevents them from being dislodged from the probe housing. The upper ends of the pins are adapted to interface to the electrical contacts of the second electrical device being connected. Electrical signals run through the pins and the ACE. This provides a short path, low-inductance separable electrical contact with sufficient vertical compliance to be used for test and burn-in of chips and other electrical components.

Figure 1A:
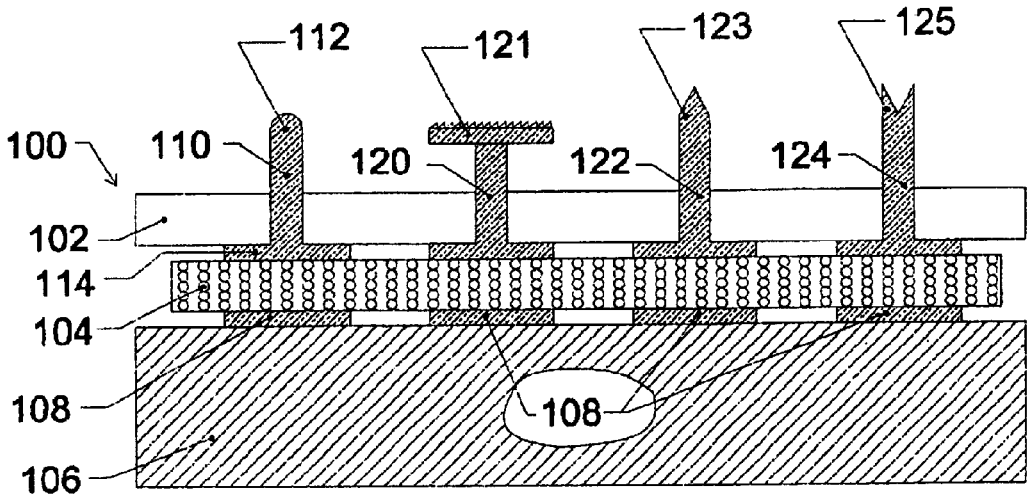
FIG. 1A is a schematic side view of one preferred embodiment of the pin-array, separable, compliant electrical contact member of the invention.

There is shown in FIG. 1A pin-array, separable, vertically-compliant electrical contact member 100 according to this invention. Member 100 is used to separably, electrically interconnect a first electrical device having electrical contacts to a second electrical device having electrical contacts. In the drawings, one electrical device is shown as printed circuit board 106 having electrical contacts 108 on its upper surface. Contacts 108 are typically pads or lands. The second electrical device is not shown in the drawings. Electrical contact member 100 includes a plurality of conductive pin probes 110, 120, 122 and 124. Each of these pins is located in an opening in probe housing 102. Probe housing 102 is a non-conductive member that carries and properly locates the pins for the particular use. One example of probe housing 102 would be a sheet Kapton or FR4 printed circuit board material with holes of the correct shape and size for the pin probes drilled or punched at the desired locations such that the pins of the array are properly located to electrically interconnect the electrical contacts of a chip to contacts 108 on substrate 106.

Each pin defines an enlargement larger than the opening in probe housing 102 in which the pin is located. Enlargement 114 of pin 110 prevents pin 110 from being lifted out of the opening in probe housing 102. The other end 112 of pin 110 is preferably shaped to provide a desired electrical contact with the other electrical device being contacted with contact member 100. Several different possible contact shapes are shown in FIG. 1A for illustrative purposes only. Typically, all of the contacts would be the same shape and adapted to contact the particular shape of the electrical contacts (e.g., ball grid arrays or land grid arrays) being contacted by the pins. This shape is selected to optimize the connection to the contacts of the device. Shapes include partially spherical ball 112, flat member 121, or triangular or saddle-shaped contacts 123 and 125, respectively. The contacts at the pin ends could have asperities to break through oxides on an electrical contact. Member 121 also depicts two enlargements which can be useful to both fully prevent the pin from falling from the probe housing, and also matching the sizes and shapes of the contacts above and below the member.

Depending on the application, pads 121 typically would have a diameter comparable to the land or solder ball diameter. The pins have a height sufficient for the desired purpose. For example, shorter pins of around 5–20 mils in length can be held in a single sheet of Kapton that acts as the probe housing. Pins can have lengths up to around 75–100 mils, or more. The pins should be supported by the probe housing along a good portion of their lengths. Typically, pins of the order of 20–75 mils in length can be held in a single block of FR4, or in a double-layer probe housing as explained below. Longer pins would probably be held in a double-layer probe housing. The compliance of Kapton may allow for one of the ends of the pins to be actively pushed through the hole without pushing the opposing end through the hole as well. The pin floats in the hole by virtue of the reduced diameter middle portion and is retained in the hole by virtue of the larger end portions. The pin can move up and down the length of the waist while being held in place laterally. The vertical motion transfers the contour of the device to the ACE layer.

The floating pins may be machined from metal such as brass using a screw machine tool, and barrel plated with gold or solder. Alternatively, the pins may be molded from plastic and plated to create the conductive path. The housing and pins can both be molded in place with different plastics, in which the plastic making up the housing is of a type that will not accept metal plating, and the plastic used to mold the pins will accept metal plating. The plating process starts with an electroless copper plate and is followed with nickel and solder or gold as needed. These plating techniques are well known to those skilled in the art of plating. Asperities 121 may be formed on the pins by using a mold insert having a roughened inside surface that may then be coated with plating as desired.

Contact member 100 also includes a layer 104 of ACE adjacent probe housing 102 and comprising a plurality of conductive chains of particles through the layer's thickness and aligned perpendicularly to the major surfaces of layer 104. These chains provide one or more conductive paths between each pin and each contact on the substrate.

ACE requires a compressive force in the axial direction of the chains of conductive particles. Fifty grams is a typical compressive force requirement. This force is provided through the pins. The compressive force is typically accomplished through the chip or other electrical device (not shown in the drawings) that is in contact with the tops of the pins. The electrical continuity between the electrical devices can be maximized by making pin enlargements 114 the same size and shape as contacts 108 on board 106.

Figure 1B:
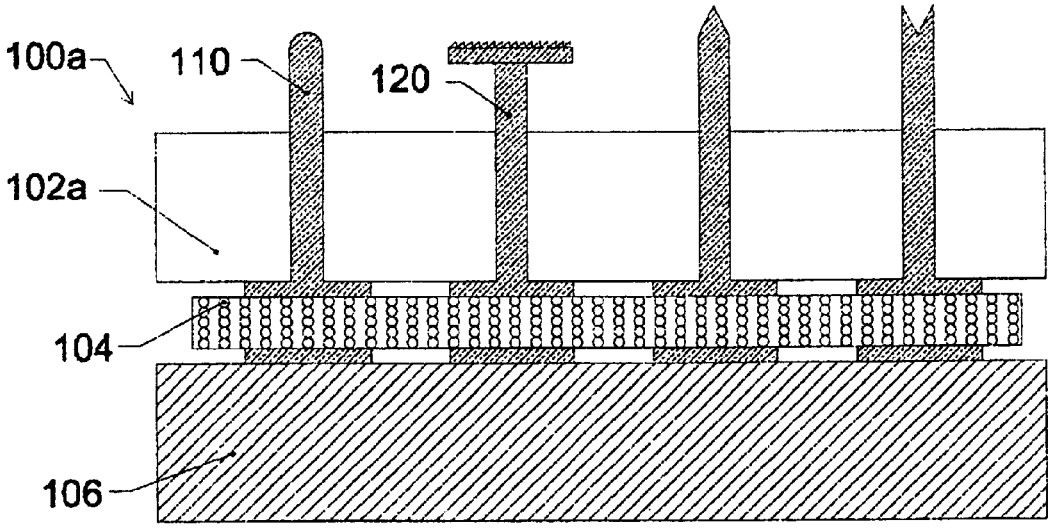

FIG. 1B shows a similar electrical contact member 100*a* with a single layer probe housing 102*a* that is much thicker than probe housing 102, FIG. 1A.

FIG. 2 shows several additional considerations of this invention. Electrical contact member 150 includes probe housing 152 that defines interior cavity 164. Pins 160 include enlargement 162 that is larger than the opening in upper layer 154 and lower layer 156 of probe housing 152. Layers 154 and 156 and spacer 158 enclose cavity 164 that has sufficient height such that pins 160 can move up and down in the direction of arrow A to provide a desired level of compliance. The contact member vertical compliance is provided by compressible ACE layer 104. Layer 104 in this case is directly coupled to probe housing 152 by adhesive 170. Probe housing 152 and ACE layer 104 thus are a unit that can be placed on circuit board 106*a* to connect the board to the device (such as a chip) that is placed on top of the pin array. The use of adhesive 170 also allows the ACE to be held in tension, which causes the major elastomer surfaces of the ACE between the conductive columns to bow slightly inward. This creates surface voids into which the polymer material can expand as it is heated during the test operation. The means by which ACE can be maintained in tension in an electrical connector are further disclosed in U.S. Pat. Nos. 6,447,308 and 6,497,583, incorporated herein by reference.

Another feature shown in FIG. 2 is the matching of the size of the lower ends of the pins that contact the ACE layer to the size of the contacts 108*a* being connected to by the contact member. The pins can be tailored to be have a desired size and shape at their lower ends.

Yet another feature of the invention in FIG. 2 is its adaptation to allow its use on boards having protruding electrical or mechanical members on the surface against which the electrical member is placed. Components 180 and 182 protrude from the upper surface of board 106*a*. Such protruding features can be accommodated in the inventive electrical member by creating an appropriately sized opening in both the ACE layer and the probe housing. Since the ACE is directly coupled to the probe housing, the two are an assembly that can be placed over components 180 and 182. This also accommodates protrusions in the underside of the chip or other device that is placed on the probe housing. Registration of the electrical contact member to the underlying board can be accomplished in a desired manner, such as explained in further detail below. Probe housing 152 can be designed to have a thickness sufficient to accommodate components 180 and 182, so that the tops of the pins are higher than the components.

Cable assembly 107 can be connected to board 106*a*. This would provide a test capability for use in very high-speed test systems. Board 106*a* could be a small pc board designed with high frequency capability. An impedance-matched, high performance cable material would be used, along with a low-loss connection between cable 107 and board 106*a*. The other end of cable 107 would be connected to measurement equipment. The device under test, contact member 150 and cable 107 could be moved robotically between test sites in an automated system.

FIG. 3 details additional features of the invention. Probe housing 102*a* is a solid, thicker sheet of FR4 or the like similar to that shown in FIG. 1B. Adhesive 170 holds ACE layer 104 on probe housing 102*a*. Pin enlargements 114 contact ACE layer 104 at matching locations to underlying board pads 108.

Probe housing 152 disclosed in FIG. 2 is also used in the embodiment shown in FIG. 4. In this case, ACE layer 104 is not directly coupled to probe housing 152 but rather is coupled to frame 190 that receives probe housing 152. Frame 190 can hold ACE layer 104 in tension through use of mechanical fasteners or an adhesive substance, as desired. If frame 190 is properly aligned to board 106*a*, frame 190 can also properly position probe housing 152 relative to board 106*a*, thus insuring the proper alignment of the pins with the electrical contacts on the surface of board 106*a* as shown in the drawing.

FIG. 5 discloses yet another embodiment of the invention with a recessed-pin probe housing 202 that in its normal, uncompressed state shown in the drawing presents probe housing upper surface 204 that is higher than the tops of pin probes 160. This protects the top of the pin probes from being mechanically affected when an object is placed on top of probe housing 204 for interconnection with board 106*a*. Lower member 205 of probe housing 204 is mechanically registered to frame 190*a* to which ACE layer 104 is attached. Registration of frame 190*a* to board 106*a* thus also accomplishes proper registration of probe housing 204 to board 106*a*. Electrical contact is accomplished by downward pressure in direction of arrow B accomplished through the second component (e.g., a chip) that is placed on probe housing 204. Spring 210 holds upper probe housing member 206 at a height sufficient so that upper surface 204 is above the upper ends of pins 160. As the component is pushed down in the direction of arrow B, spring 210 compresses. Member 212 acts as a spring guide, and also holds upper layer 206 relative to lower layer 205. When the upper ends of pins 160 are above surface 204 of probe housing 206, electrical contact is made.

FIGS. 6A and 6B depict another embodiment 300, in which an alignment frame is used to align the probe housing to the underlying board, without needing to penetrate the ACE layer. Alignment frame 330 is aligned to board 302 by one or more alignment pins 332. ACE layer 304 is coupled to frame 306, which is held in place by frame 330. Compressible probe housing 308 comprises lower layer 310 and upper layer 312, separated by compressible spring 320 that rides on pin 322. Pin 322 properly aligns probe housing 308 to frame 330, and since frame 330 is aligned to board 302, the result is that the probe housing is properly aligned with the board without disturbing the ACE layer.

Probe housing 308 is designed such that in the uncompressed state (before its use) as shown in FIG. 6A, the top of portion 312 is above the tops of pins 314, thus protecting the pins from damage. When the chip is placed onto housing 308 and pushed down, spring 320 is compressed and portion 312 moves down, allowing the chip's electrical contacts to touch pins 314. Sufficient compressive force for the ACE is provided through downward pressure on the chip. This is shown (without the chip) in FIG. 6B.

A double-ended electrical contact member 340 is shown in FIG. 7. Single ended contact members 342 and 344 are constructed in a manner as described above. ACE layer 346 between members 342 and 344 provides the vertical compliance. Member 340 presents double-ended pins, and thus can be used as a direct replacement for a pogo pin connector.

Other embodiments will occur to those skilled in the art and are within the following claims.

What is claimed is:

1. A pin-array, separable, compliant electrical contact member for separably, electrically interconnecting a first electrical device having electrical contacts to a second electrical device having electrical contacts, comprising:

a probe housing having a thickness, and defining a plurality of openings through the thickness;

one or more pin probes, each pin probe located in and protruding from an opening in the probe housing, and each defining an enlargement larger than the opening in which the pin is located, to inhibit lateral pin motion, and also prevent the pins from being removed from their openings vertically in at least one direction; and a layer of Anisotropic Conductive Elastomer (ACE) adjacent to the probe housing and comprising a plurality of conductive chains of particles through the layer thickness and aligned generally perpendicularly to the layer's major surfaces;

wherein one end of the pin probes are in contact with the electrical contacts of the first electrical device, and the other ends of the pin probes are in compressive contact with a major surface of the ACE layer, and wherein the other major surface of the ACE layer is in contact with the electrical device, such that electrical signals are passed between the two electrical devices through the pin probes and the ACE layer.

2. The separable, compliant pin-array electrical contact member of claim 1 wherein the pin enlargements are on the ends of the pins that are in contact with the ACE layer, to also increase the contact area at the ACE major surface.

3. The separable, compliant pin-array electrical contact member of claim 1 wherein the probe housing comprises a single sheet.

4. The separable, compliant pin-array electrical contact member of claim 1 wherein the probe housing comprises at least two spaced sheets.

5. The separable, compliant pin-array electrical contact member of claim 1 wherein the pin ends that are in contact with the ACE layer are substantially flat.

6. The separable, compliant pin-array electrical contact member of claim 1 wherein the electrical contacts on the first electrical device have a particular end shape, and the ends of the pins in contact with them have a complementary shape to maximize contact area and minimize contact damage.

7. The separable, compliant pin-array electrical contact member of claim 1 wherein the ACE layer is coupled to the probe housing.

8. The separable, compliant pin-array electrical contact member of claim 7 wherein the ACE layer is coupled to the probe housing by an adhesive.

9. The separable, compliant pin-array electrical contact member of claim 7 wherein the ACE layer is held in tension.

10. The separable, compliant pin-array electrical contact member of claim 1 wherein the ACE layer is not continuous, and the probe housing defines an opening above the ACE layer discontinuity, to allow the contact member to be placed on a substrate with components protruding from its surface.

11. The separable, compliant pin-array electrical contact member of claim 1 wherein the pin enlargements are captured within the probe housing.

12. The separable, compliant pin-array electrical contact member of claim 11 wherein the probe housing comprises vertically spaced layers defining a cavity within which the pin enlargements are captured.

13. The separable, compliant pin-array electrical contact member of claim 1 further comprising a frame to which the ACE layer is coupled.

14. The separable, compliant pin-array electrical contact member of claim 13 wherein the ACE layer is held in tension by the frame.

15. The separable, compliant pin-array electrical contact member of claim 13 wherein the probe housing fits within the frame.

16. The separable, compliant pin-array electrical contact member of claim 1 further comprising means for aligning the probe housing to the second electrical device.

17. The separable, compliant pin-array electrical contact member of claim 16 wherein the means for aligning includes alignment pins.

18. The separable, compliant pin-array electrical contact member of claim 17, further comprising an alignment frame, wherein the alignment frame is coupled to the second electrical device with alignment pins, and the probe housing is coupled to the alignment frame by alignment pins.

19. The separable, compliant pin-array electrical contact member of claim 1 wherein the probe housing is vertically compressible.

20. The separable, compliant pin-array electrical contact member of claim 19 wherein the probe housing comprises one or more vertically compliant members to provide vertical compliance to the housing.

21. The separable, compliant pin-array electrical contact member of claim 19 wherein the top surface of the probe housing is above the tops of the pins when it is not compressed, to protect the pins from damage.

22. A double-ended separable, compliant pin-array electrical contact member comprising two of the contact members of claim 1, with a single layer of ACE between the two contact members, to present for external connection double-ended pins.

23. A pin-array, separable, compliant electrical contact member for separably, electrically interconnecting a first electrical device having electrical contacts to a second electrical device having electrical contacts, comprising:

a probe housing having a thickness, and defining a plurality of openings through the thickness;

one or more pin probes, each pin probe located in and protruding from an opening in the probe housing, and each defining an enlargement larger than the opening in which the pin is located, to inhibit lateral pin motion, and also prevent the pins from being removed from their openings vertically in at least one direction; and a layer of Anisotropic Conductive Elastomer (ACE) adjacent to the probe housing and comprising a plurality of conductive chains of particles through the layer thickness and aligned generally perpendicularly to the layer's major surfaces;

a frame to which the ACE layer is coupled, wherein the ACE layer is held in tension by the frame, and wherein the probe housing fits within the frame;

wherein one end of the pin probes are in contact with the electrical contacts of the first electrical device, and the other ends of the pin probes are in compressive contact with a major surface of the ACE layer, and wherein the other major surface of the ACE layer is in contact with the electrical device, such that electrical signals are passed between the two electrical devices through the pin probes and the ACE layer.

24. The separable, compliant pin-array electrical contact member of claim 23 wherein the pin enlargements arc captured within the probe housing.

25. The separable, compliant pin-array electrical contact member of claim 24 wherein the probe housing comprises vertically spaced layers defining a cavity within which the pin enlargements are captured.

26. The separable, compliant pin-array electrical contact member of claim 23 further comprising means for aligning the probe housing to the second electrical device.

27. The separable, compliant pin-array electrical contact member of claim 26 wherein the means for aligning includes alignment pins.

28. The separable, compliant pin-array electrical contact member of claim 27, further comprising an alignment frame, wherein the alignment frame is coupled to the second electrical device with alignment pins, and the probe housing is coupled to the alignment frame by alignment pins.

29. The separable, compliant pin-array electrical contact member of claim 23 wherein the probe housing is vertically compressible.

30. The separable, compliant pin-array electrical contact member of claim 29 wherein the probe housing comprises one or more vertically compliant members to provide vertical compliance to the housing.

31. The separable, compliant pin-array electrical contact member of claim 29 wherein the top surface of the probe housing is above the tops of the pins when it is not compressed, to protect the pins from damage.

* * * * *